US008062123B2

(12) United States Patent
Ueda et al.

(10) Patent No.: US 8,062,123 B2
(45) Date of Patent: Nov. 22, 2011

(54) GAME SYSTEM

(75) Inventors: Noriaki Ueda, Tokyo (JP); Shuhei Fujibe, Tokyo (JP); Jiro Yoshida, Tokyo (JP); Chisaki Kusajima, Tokyo (JP); Junichi Miyamoto, Tokyo (JP); Manabu Igarashi, Tokyo (JP)

(73) Assignee: Sega Corporation, Tokyo (JP)

( * ) Notice: Subject to any disclaimer, the term of this patent is extended or adjusted under 35 U.S.C. 154(b) by 1187 days.

(21) Appl. No.: 11/499,641

(22) Filed: Aug. 7, 2006

(65) Prior Publication Data

US 2007/0060370 A1 Mar. 15, 2007

(30) Foreign Application Priority Data

Aug. 10, 2005 (JP) ..... 2005-232257

(51) Int. Cl.
*A63F 9/24* (2006.01)

(52) U.S. Cl. ..... 463/25; 463/42; 463/29

(58) Field of Classification Search ..... 463/1, 16, 463/25, 29, 42
See application file for complete search history.

(56) References Cited

U.S. PATENT DOCUMENTS 6,015,344 A * 1/2000 Kelly et al. ..... 463/16
7,515,718 B2 * 4/2009 Nguyen et al. ..... 380/278

FOREIGN PATENT DOCUMENTS

| | | |
|---|---|---|
| JP | 10-165609 | 6/1998 |
| JP | 2000-011224 | 1/2000 |
| JP | 2000-14930 A | 1/2000 |
| JP | 2005/025703 | 3/2005 |

* cited by examiner

*Primary Examiner* — David L Lewis
*Assistant Examiner* — Robert Mosser
(74) *Attorney, Agent, or Firm* — Dickstein Shapiro LLP

(57) ABSTRACT

A game system is disclosed that comprises a server system and a game parlor connected to the server system through a network, the server system forming and retaining a unit price schedule data that set a unit price for a predetermined unit time, the game parlor including a plurality of game terminals connected to a parlor LAN, and a parlor server, the game parlor retaining corresponding unit price schedule data sent from the server system to the parlor server, the plurality of game terminals accessing the parlor server at a time interval shorter than the predetermined unit time to acquire unit price information in accordance with the unit price schedule.

7 Claims, 9 Drawing Sheets

GAME SYSTEM

CROSS-REFERENCE TO RELATED APPLICATIONS

This application is based upon and claims the benefit of priority from the prior Japanese Patent Application No. 2-005-232257, filed on Aug. 10, 2005, the entire contents of which are incorporated herein by reference.

BACKGROUND OF THE INVENTION

1. Field of the Invention

The present invention relates generally to a game system, and more particularly, to a game system that sets a unit price schedule for a plurality of game terminals disposed in a plurality of parlors.

2. Description of the Related Art

As application and utilization of a network are developed, development and operation are started for a game system that manages a plurality of game terminals through a network in a centralized manner. Recently, a system is increasingly introduced which substitutes electronic money using various electronic media for actual money to settle counter value payment for commodities and services.

In these respects, the applicant previously proposed an invention about a game system using electronic money (International Public Presentation No. WO2005/025703A1). An object of the invention of International Public Presentation No. WO2005/025703A1 is to prevent games from starting despite the intention of players and to prevent procedures for starting games from being complicated when a plurality of the players has electronic money and plays the games.

A system is proposed for performing comprehensive central control of data such as operation time for each group in a system managing a plurality of game machines that is so-called pachinko machines in a centralized manner (Japanese Patent Application Laid-Open Publication No. 1998-165609). That is, in the invention described in Japanese Patent Application Laid-Open Publication No. 1998-165609, groups are made from a plurality of pachinko machines in one parlor, and operational condition and business status for one week are accurately comprehended for each group and are displayed on a display apparatus to perform comprehensive central control of data such as the number of playing customers and operation time of game machines.

In another technology, a method is proposed for setting a unit price when utilizing a plurality of gate devices in a ski site (Japanese Patent Application Laid-Open Publication No. 2000-11224). In the invention described in Japanese Patent Application Laid-Open Publication No. 2000-11224, each device has a calendar function to set a sales unit price in accordance with a day of the week, specified dates, and business hours, and active/inactive of the device for each device all through the season. That is, in the invention described in Japanese Patent Application Laid-Open Publication No. 2000-11224, each terminal device has a schedule function to set a unit price to a preset sales unit price in the device in accordance with a schedule.

With regard to a game system, generally, 200 to 300 game terminals are connected through a game parlor LAN in one parlor. A plurality of game parlors is connected through a network such as the Internet.

On the other hand, each game terminal must be linked to a settlement terminal that accepts actual money or electronic money to allow a player to play a game at a game terminal.

Normally, a unit price is set to execution of one game (provision of service) at the game terminal.

Therefore, as described above, the large total number of the terminals exists in a game system and the game terminal may be temporarily disconnected from the LAN when devices are replaced to change game versions or due to failures, etc. In consideration of such a situation, it is difficult to perform the unit price changing setup easily even when each terminal device (game terminal) described in Japanese Patent Application Laid-Open Publication No. 2000-11224 has a schedule function to set a selling unit price in the terminal in accordance with a preset schedule.

That is, it is difficult to change a unit price to enhance attraction for customers correspondingly to a customer operating status and to perform the unit price changing setup for a plurality of game terminals in a centralized manner.

SUMMARY OF THE INVENTION

It is therefore the object of the present invention to provide a game system with a plurality of game terminals, which can easily set a unit price for each game terminal correspondingly to a time schedule.

A first aspect of the present invention solving the above problem provides a game system comprising a server system and a game parlor connected to the server system through a network; the server system forms and retains a unit price schedule data that set a unit price for a predetermined unit time; the game parlor includes a plurality of game terminals connected to a parlor LAN, and a parlor server; the game parlor retains corresponding unit price schedule data sent from the server system to the parlor server; and the plurality of game terminals accesses the parlor server at a time interval shorter than the predetermined unit time to acquire unit price information in accordance with the unit price schedule.

In one implementation of the first aspect, when a current unit price acquired by accessing the parlor server is different from a unit price scheduled for a next time period in accordance with the unit price schedule, the plurality of game terminals can change setting of the game unit price to the scheduled unit price.

In one implementation, the game system includes a parlor management terminal corresponding to a parlor and the parlor management terminal can perform an update process of the unit price schedule on an interface screen provided from the server system or created through image generation by the parlor management terminal itself.

The interface screen provided from the server system may be a web browser screen of the server system.

The interface screen created through image generation by the parlor management terminal itself may be created by the parlor management terminal itself with a Java (registered trademark) application provided from the server system.

In one implementation, the parlor management terminal registers a plurality of game terminals as a unit price group and applies a corresponding unit price schedule to the game terminals included in the unit price group on the interface screen.

In one implementation, each of the plurality of game terminals includes a game device and a settlement terminal linked to the game device; the store management terminal registers the game device and the settlement terminal linked to the game device on the interface screen; and the settlement terminal linked to the registered game device processes a unit price in accordance with the unit price schedule for a game executed on the game device.

In one implementation, when the parlor management terminal registers the game device and the settlement terminal linked to the game device, if a plurality of the settlement terminals is associated with one game terminal, registration can be performed to link the plurality of the settlement terminals to the game device constituting the game terminal.

A game terminal according to the present invention can be realized with a simple configuration without the need of a configuration including scheduling data, can constitute a game system inexpensively, and can change unit price setup easily.

BRIEF DESCRIPTION OF DRAWINGS

Features of the present invention will become more apparent from the following embodiment described with reference to the accompanying drawings, in which.

DETAILED DESCRIPTION OF THE PREFERRED EMBODIMENTS

An embodiment of the present invention will hereinafter be described with reference to the drawings. The embodiment is for the purpose of understanding of the present invention and does not limit the technical scope of the present invention.

Figure 1:
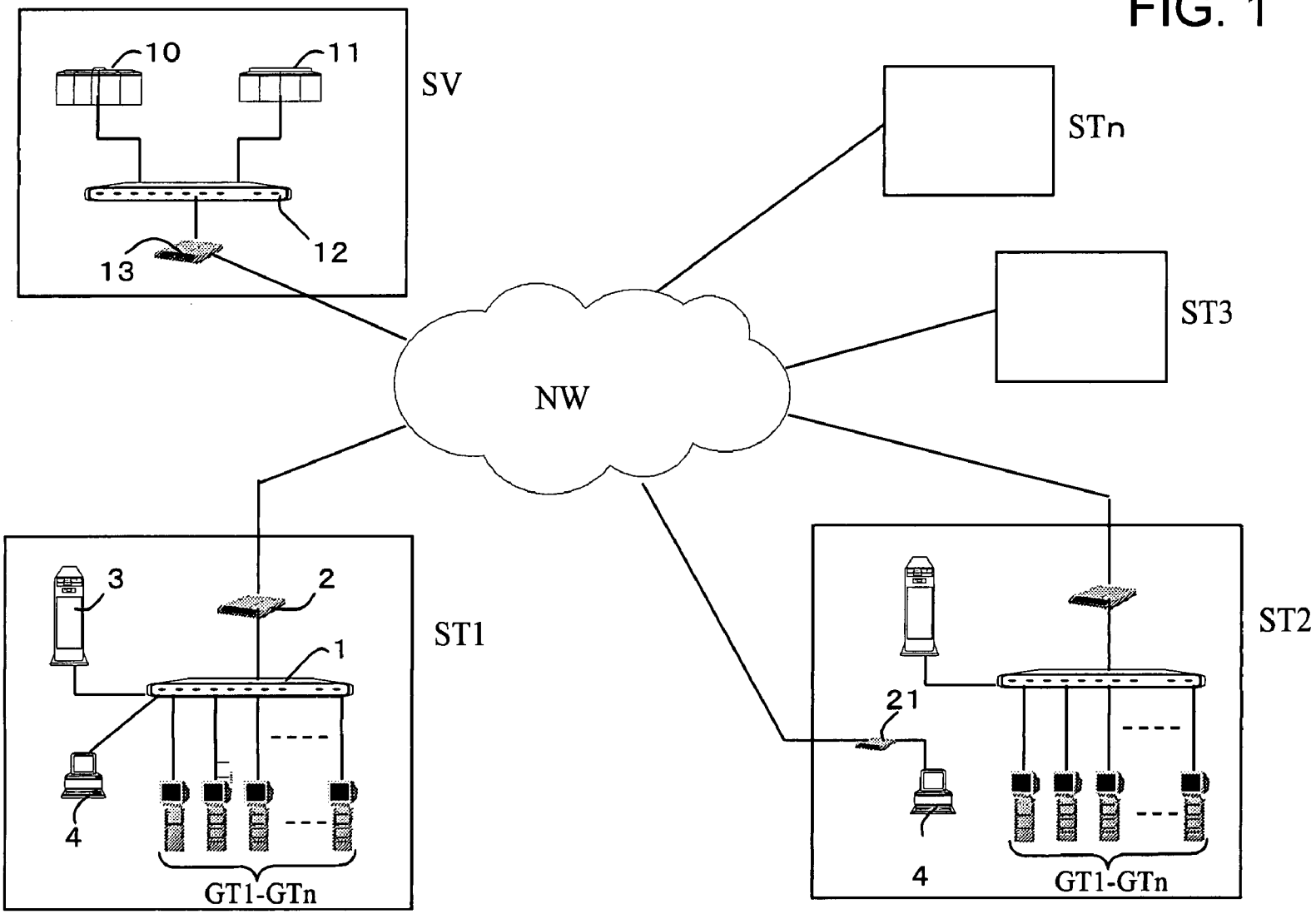
FIG. 1 shows an example of a game system according to the present invention.

FIG. 1 shows an example of a game system according to the present invention. A plurality of game parlors ST1 to STn is connected to a network NW such as the Internet. A server system SV is connected to the network NW and transmits and receives data to and from the plurality of the game parlors ST1 to STn.

[Server System SV]

The server system SV has a database server 10 and an application server 11. These servers are connected to form a LAN within the server system SV and connected to the network NW such as the Internet through a switching hub 12 and a router 13.

The data server 10 retains unit price schedule data described in detail later. The application server 11 has a function of a web server as an application and provides a GUI (Graphical User Interface) to a parlor management terminal such that unit schedule data sent from the data server 10 can be browsed on a web browser screen in each game parlor described later. Using the web browser is advantageous in that (i) a dedicated browser does not have to be developed (development cost and time can be reduced) and (ii) everyone is familiar with and can easily use the GUI without additional learning.

In the following description of the embodiment, a desiccated browser may be used instead of a web browser screen of the application server 11 provided to the parlor management terminal from the application server 11.

The application server 11 may retain the unit price schedule data and the dedicated browser may be achieved on an interface screen generated by the parlor management terminal itself with a browser plug-in provided from the server system. By using the browser plug-in, (i) the interface screen function can be added to the web browser without a user of the parlor management terminal actively installing a program. (ii) Since the browser plug-in is executed on the parlor management terminal, the burden of the application server can be reduced.

The browser plug-in is a program executed so as to add a function to the web browser, such as the Java (registered trademark) applet (plug-in written in the Java (registered trademark) language) and the ActiveX control (plug-in constituted by object codes).

[Game Parlors ST1 to STn]

On the other hand, the plurality of the game terminals ST1 to STn has substantially the same configuration. For example, the game parlor ST1 includes a plurality of game terminals GT1 to GTn and a plurality of groups is formed from the game terminals GT1 to GTn based on game genres, categories, etc. The plurality of the game terminals GT1 to GTn is connected to a parlor server to form a LAN. The plurality of the game terminals GT1 to GTn is connected to the network NW through a switching hub 1 and a router 2.

The parlor LAN includes a parlor management terminal 4 corresponding to a parlor. The parlor management terminal 4 is connected to the network NW through the parlor LAN or through a router 21 independently from the parlor LAN as shown in the game parlor ST2 of FIG. 1.

Figure 2:
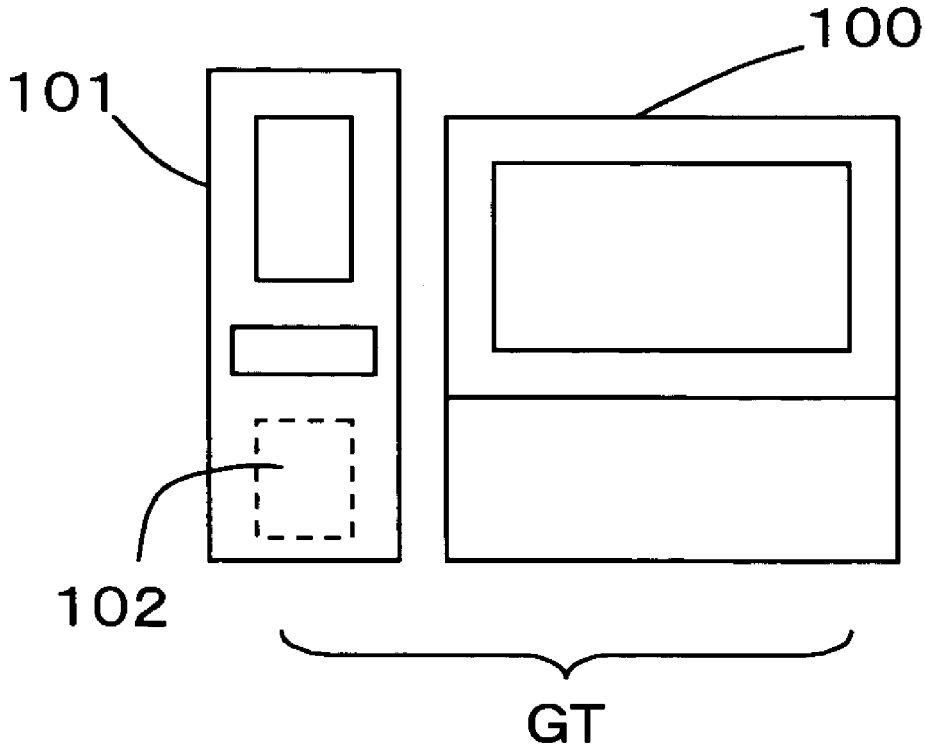
FIG. 2 is a configuration example of a game terminal located in a game parlor.

FIG. 2 is a configuration example of a game terminal. A game device 100 and a settlement terminal 101 such as an electronic money terminal are attached to the game terminal GT1. However, the attachment relationship of the game device 100 and the settlement terminal 101 can be changed appropriately. For example, the game device itself can have the settlement terminal function. In this case, the settlement terminal may not be attached separately. The settlement terminal 101 has a communication unit 102 and is connected to a parlor server 3.

[Timing Setup]

In the game system according to the present invention, it is important to set a unit price in each game terminal correspondingly to a time schedule. Therefore, a timer in the data server 10 is set as a master clock. That is, the parlor server 3 in each game parlor ST1 to STn accesses the data server 10 periodically and is synchronized with the master clock of the data server 10.

The game terminals in the game parlor are powered on daily at the opening of business and powered off at the close of business. Therefore, when the game terminals are powered on at the opening of business, the power-on state is recognized by the corresponding parlor server 3; as a result, the timers in the game terminals are synchronized to the timer of the parlor server 3; and therefore, the timing of the overall game system is synchronized.

[Correlated Setup of Game Device and Settlement Terminal]

The game terminal GT1 to GTn includes a combination of the game device 100 and the settlement terminal 101 as described in FIG. 2. At the opening of business of the game parlor of when the combination of the game device 100 and the settlement terminal 101 are changed, a parlor manager opens the web browser of the application server 11 from the parlor management terminal 4 to retrieve the game device for attaching or removing the settlement terminal 101.

Figure 3A:
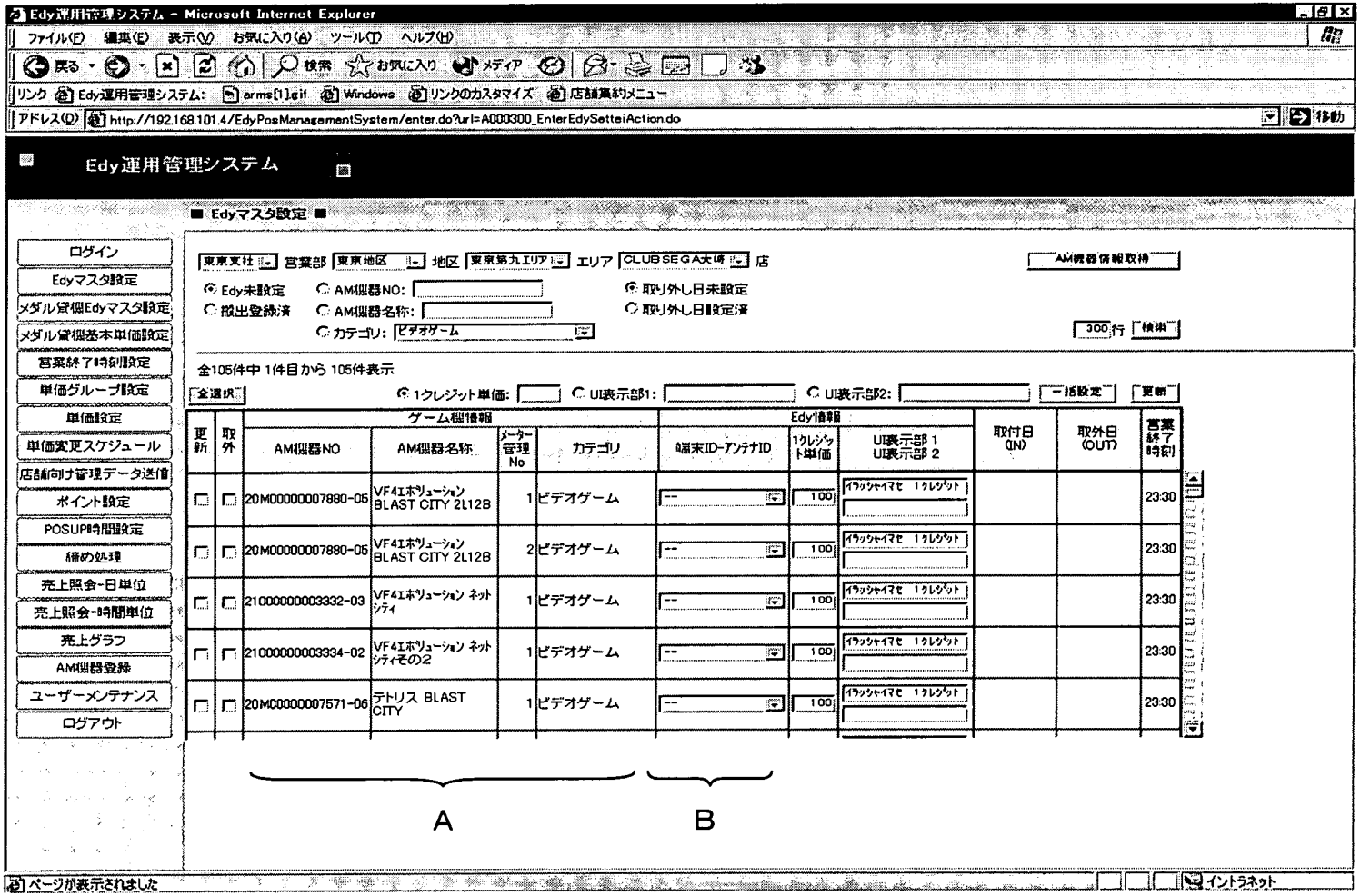
FIG. 3A is an example of a web browser screen used to register a linking relationship of a game device and a settlement terminal of an operating game terminal.

FIG. 3A is an example of a web browser screen and the web browser screen used to register a linking relationship of the game device 100 and the settlement terminal 101 of the operating game terminal. The retrieved game (AM) devices are displayed by game device numbers and names (A of FIG. 3A). The attached settlement terminal Ids are input for the retrieved game terminals (B of FIG. 3A). As a result, the linking relationship of the game device 100 and the settlement terminal 101 of the operating game terminal is registered in the data server 10.

Figure 3B:
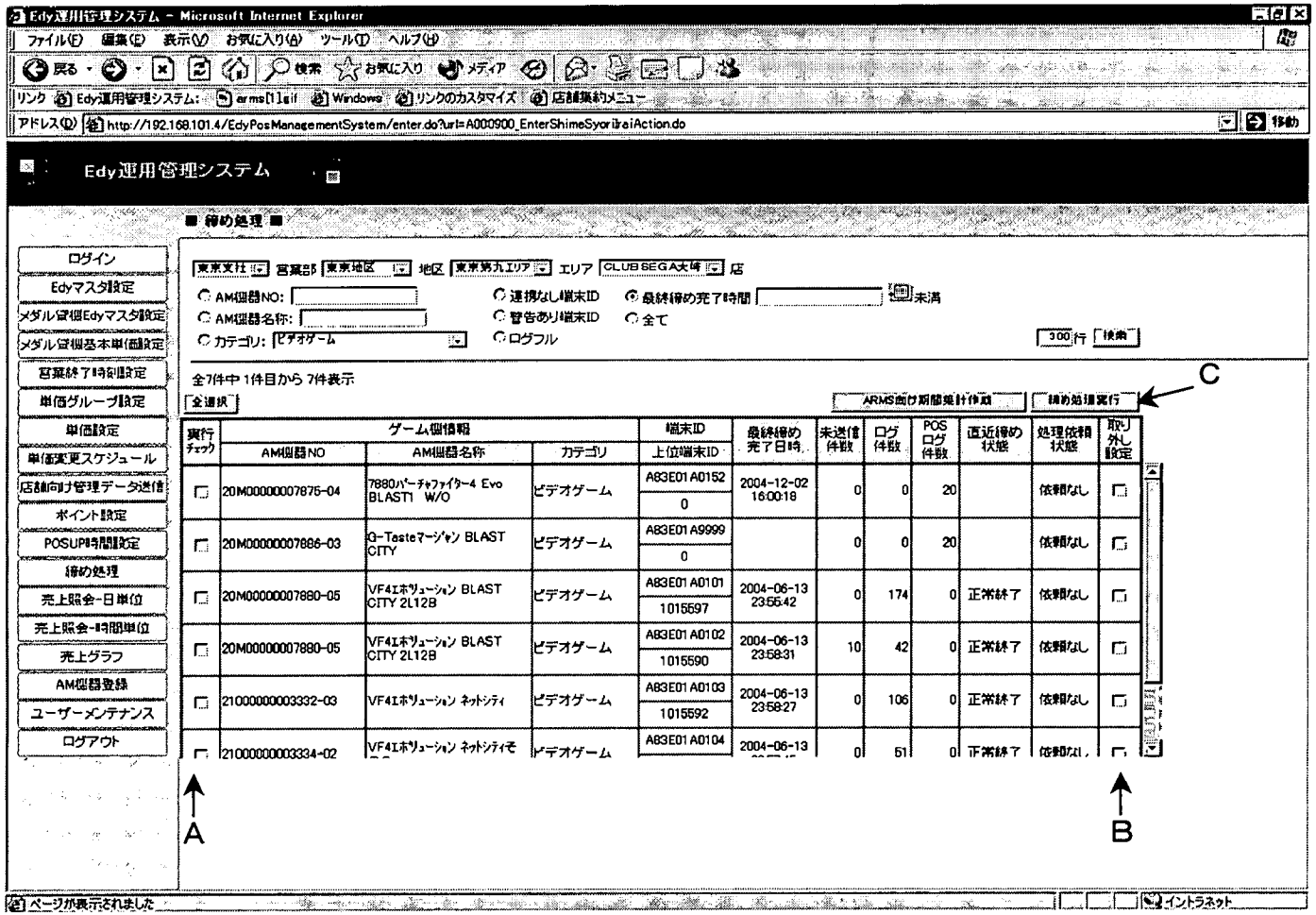
FIG. 3B is an example of a web browser screen executing a settling process on a server system SV.

If the registered linking relationship of the game device 100 and the settlement terminal 101 is cancelled, the cancellation is performed on a web browser screen of FIG. 3B for executing a settling process that collects sales data of terminal IDs with the server system SV.

In FIG. 3B, when removal of the terminal is executed for the terminal ID that is a target of the settling process with an execution check field checked (A of FIG. 3B), a removal field (B of FIG. 3B) is further checked and a settling process button (C of FIG. 3B) is pressed down. As a result, the settling process is performed for the checked terminal ID and if the removal field is checked, the terminal is removed after the settling process.

If a game is executed by putting in a predetermined medal in the game terminal GT1 to GTn, lending out of the medal must be performed. If the lending out of the medal is performed with the use of electronic money, a medal lending machine must be recognized in the same way as the game device to link the medal lending machine and the settlement terminal. In such a case, the web browser screen is also used as shown in FIG. 3A.

[Setup of Basic Unit Price]

Figure 4:
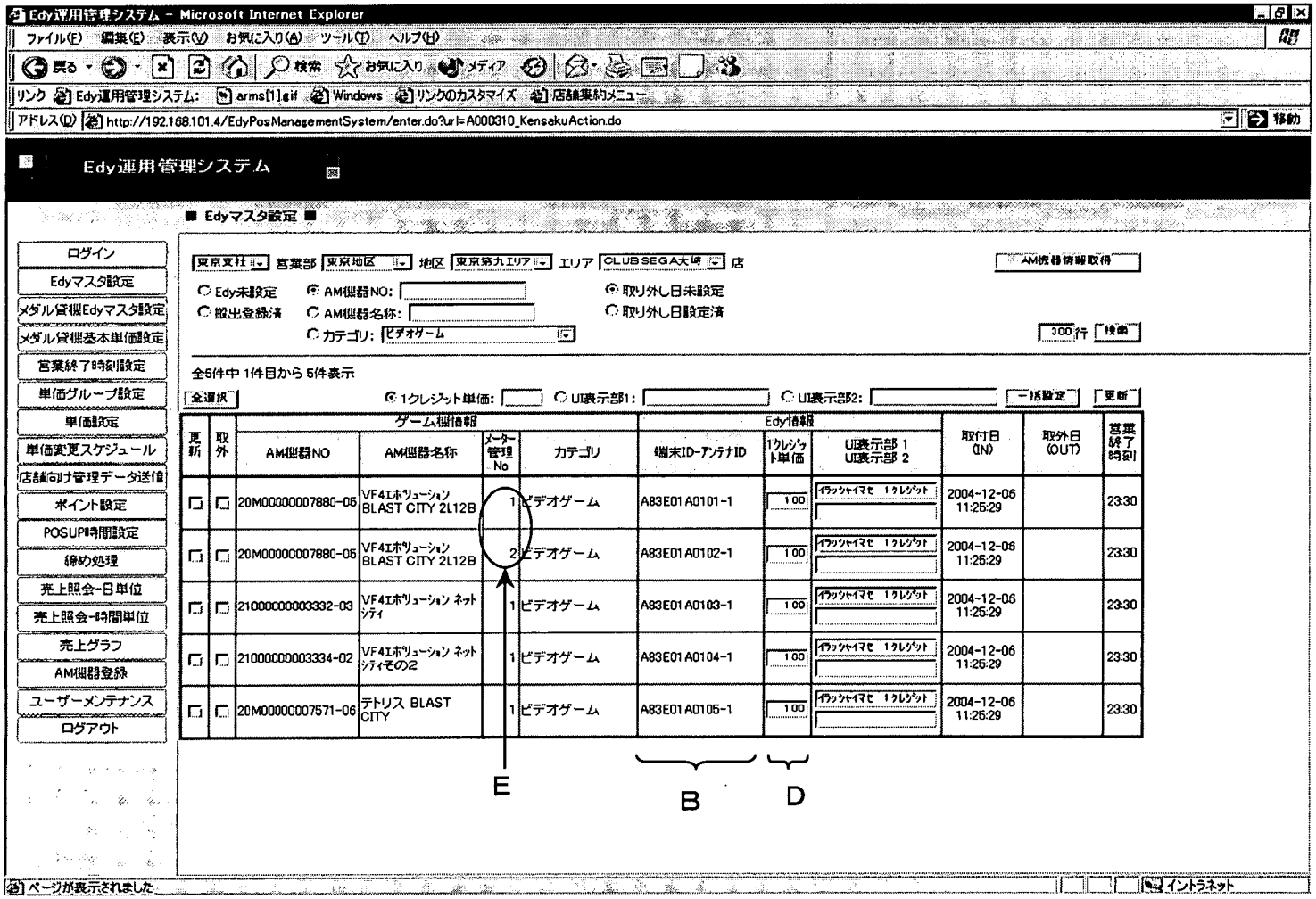
FIG. 4 is an example of a web browser screen when the linking relationship is set between the game device and the settlement terminal through the process shown in FIG. 3A and a basic unit process is registered.

FIG. 4 is an example of a web browser screen when the linking relationship is set between the game device 100 and the settlement terminal 101 through the process shown in FIG. 3A and a basic unit process is registered.

That is, the game device numbers, names, and associated settlement terminal IDs (B of FIG. 4) are displayed, and amounts of unit prices are displayed in unit price fields (D of FIG. 4).

In FIG. 4, two meter management numbers 1, 2 are added to the same game device number and name (E of FIG. 4). This means that a plurality of players can play a game with one game device and therefore, this is an example of the registration such that a plurality (two in the example of FIG. 4) of the settlement terminals has the linking relationship in such a case. Since a plurality of the settlement terminals is related and managed to be arranged and displayed on the interface screen, the unit price setup of the plurality of the settlement terminal can be prevented from being improperly set to different unit prices.

[Setup of Unit Price Group]

When setting game unit prices of a plurality of the game terminals GT1 to GTn, a unit price changing schedule can be easily set by grouping the game terminals based on game genres, categories, etc.

Figure 5:
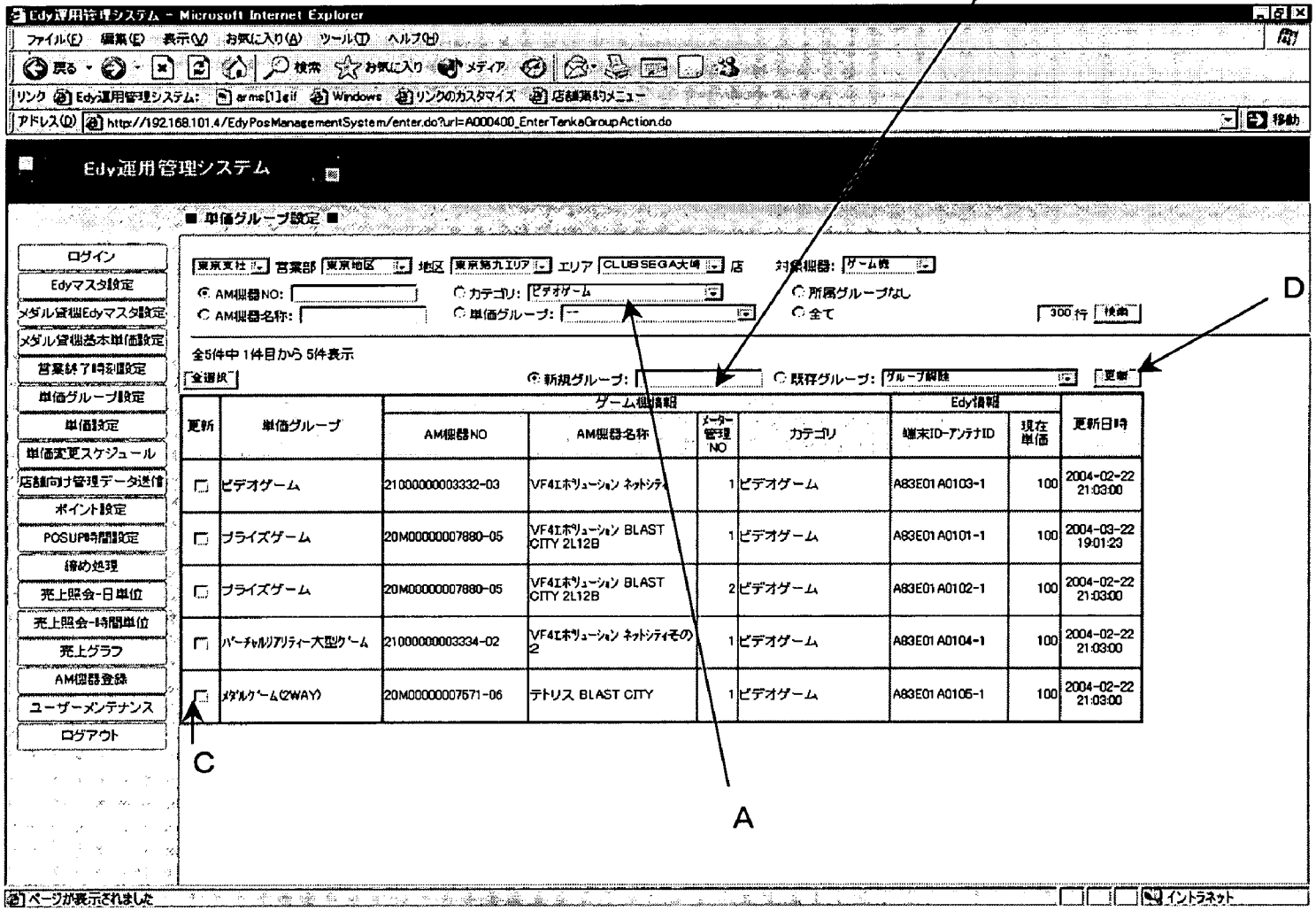
FIG. 5 is a screen example of a web browser of an application server, which is displayed on a parlor management terminal when newly setting a unit price group.

FIG. 5 is a screen example of the web browser of the application server 11, which is displayed on the parlor management terminal 4 when newly setting the unit price group. For example, when the video game is entered in a category field (A of FIG. 5) for retrieval, the game devices within a video game category are retrieved and displayed on the web screen.

If the same group is newly set among the displayed terminal devices, a new group name is entered (B of FIG. 5) and the game devices to be included in the group are checked (C of FIG. 5). By pressing an update button (D of FIG. 5), the newly entered unit price group is set.

[Setup of Unit Price Schedule]

For the unit price group set as described above, a special unit price can be set for a schedule period to be set. By defining the special unit price for the schedule period, the attraction for customers can be enhanced and the business effect can be improved.

Figure 6:
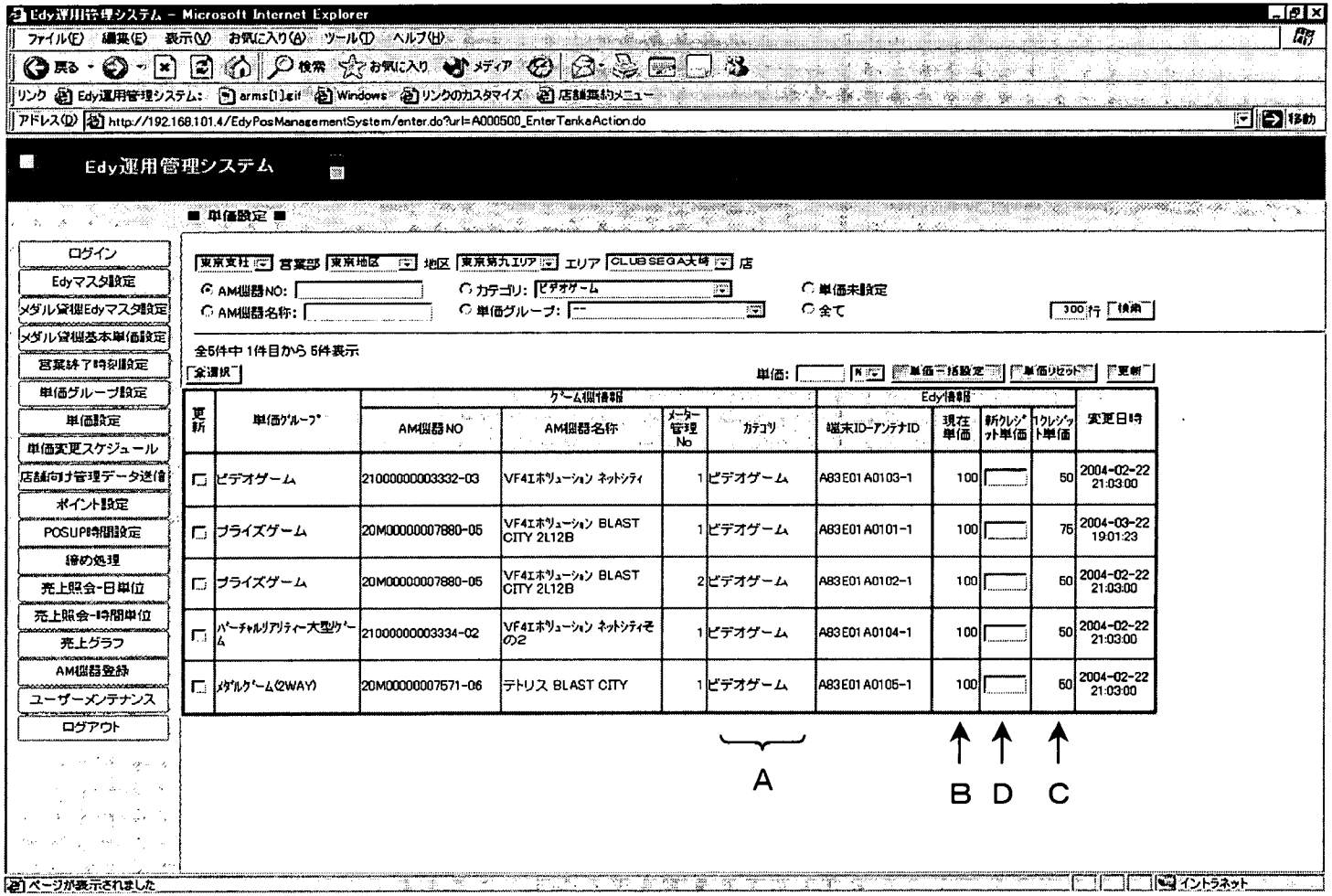
FIG. 6 is a web browser screen for entering a schedule unit price for each game device belonging to a retrieved unit price group.

The unit prices can be set to the same prices for all the game devices in the unit price group or can be set differently for each game device. That is, FIG. 6 is a web browser screen for entering a schedule unit price for each game device belonging to a retrieved unit price group. Although current unit prices are set to the same price in FIG. 6, the current unit prices can be set to arbitrary values on the web browser screen.

In FIG. 6, unit price groups belonging to a category of a video game are retrieved and displayed, which are unit price groups of a video game, a prize game, a virtual reality large size game, and a medal game (A of FIG. 6).

In the example shown in FIG. 6, only the prize unit price group has two game devices belonging to that group, and only one game device belongs to each of other unit price group examples.

All the game devices have current unit prices (B of FIG. 6) of the same value for periods other than the unit price schedule period (B of FIG. 6). Unit prices for the unit price schedule period are already registered and displayed in 1 credit unit price fields (C of FIG. 6). When changing the registered unit price for the unit price schedule period, the schedule unit price is updated and set by entering and updating a unit price in a new credit unit price field (D of FIG. 6).

The schedule unit price is set in each game parlor. Therefore, unit price schedule data are formed in the database server 10 for all the game parlors ST1 to STn belonging to the game system.

Figure 7:
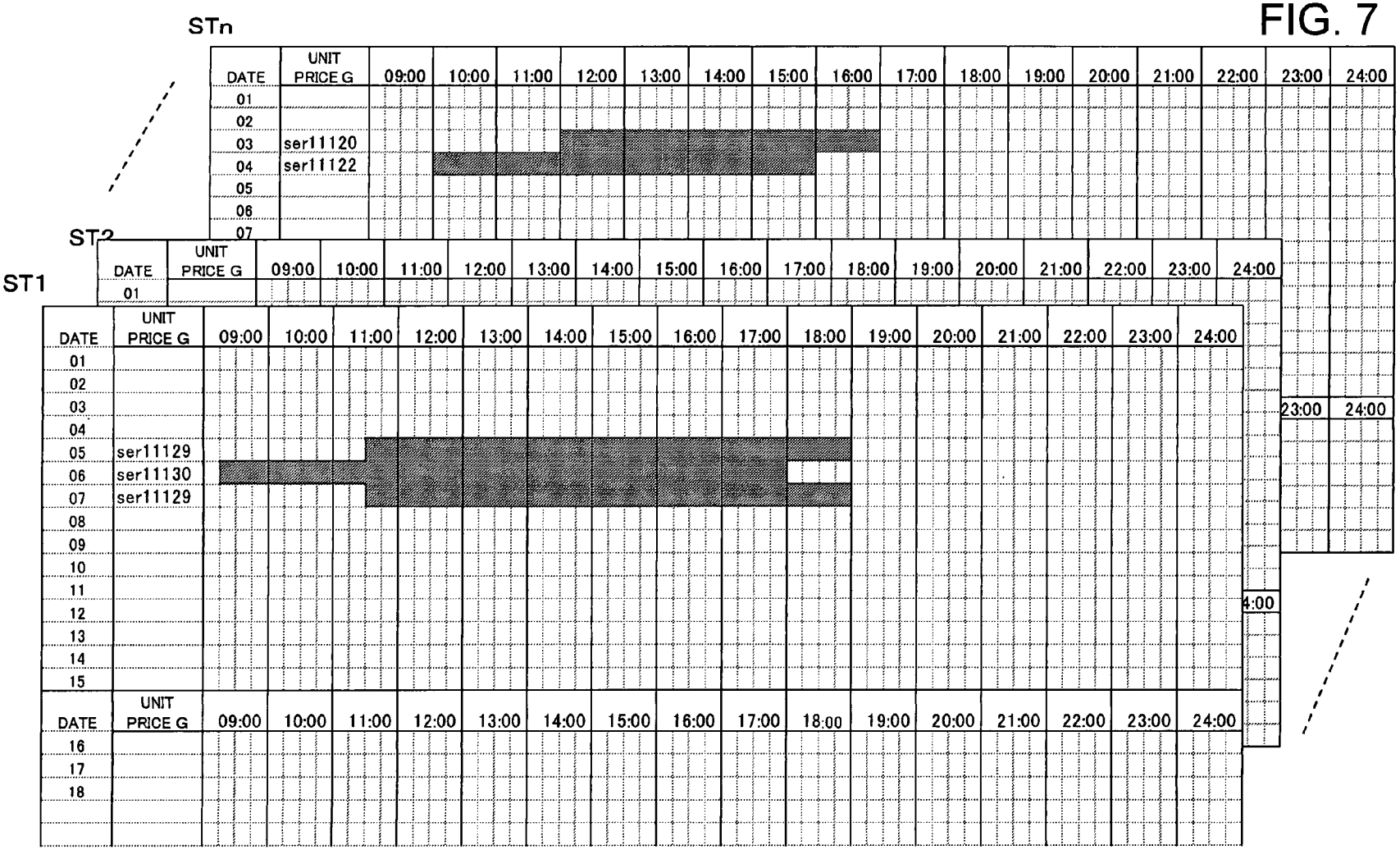
FIG. 7 is an example of a formed unit price schedule data.

FIG. 7 is an example of the formed unit price schedule data. A unit time period of the unit price schedule is set to a quarter of an hour (15 minutes). For example, in the game parlor ST1, the new credit unit price previously set in the unit price schedule is applied to a unit price group ser11129 on both day 06 and day 07 from 11:30 to 19:00. Similarly, the new credit unit price is applied in accordance with the previously set unit price schedule to a unit price group ser11130 on day 06 from 9:15 to 18:00.

The 15-minute time period is an example and the unit time can be set to any predetermined time periods such as one hour, 10 minutes, or one minute, which are included in the concept of the present invention.

[Unit Price Setup for Game Terminal]

Description will be made of a procedure of setting a unit price for the game terminal in accordance with the unit price schedule formed and retained in the data server 10 as described above.

Figure 8:
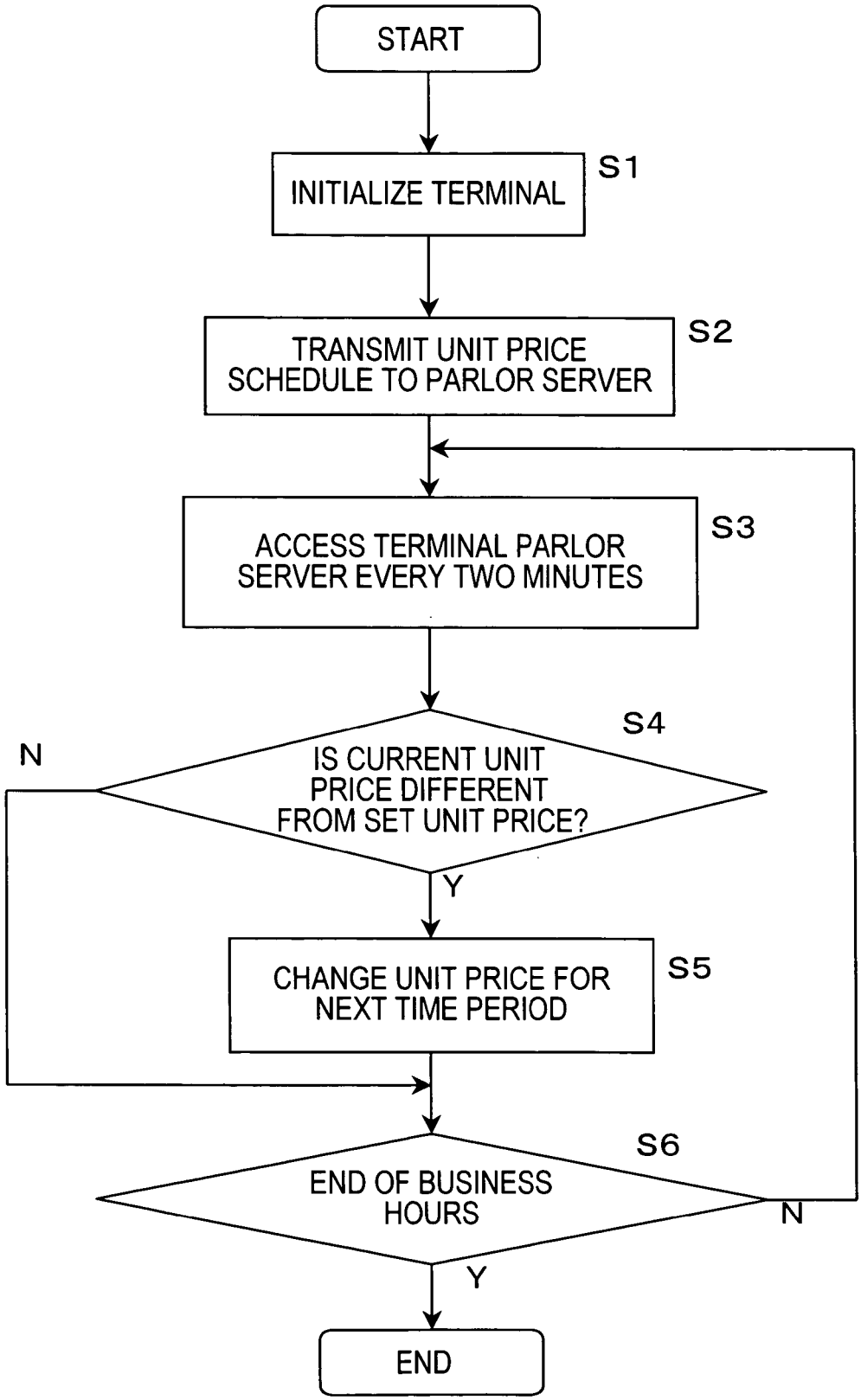
FIG. 8 is a flowchart describing a procedure of setting a unit price for the game terminal.

FIG. 8 is a flowchart describing the procedure of setting a unit price for the game terminal. Prior to activation of the game system, when the game terminals ST1 to STn are powered on at the opening of business, the power-on state is recognized by the parlor server 3 and, as a result, the timers in the game terminals are synchronized to the timer of the parlor server 3 as described above (step S1).

The data server 10 transmits the corresponding unit price schedule data to the parlor server 3 of each game parlor ST1 to STn (step S2). The price schedule data may be transmitted periodically at night when the game parlor is closed or may be transmitted in response to a transmission request sent from the parlor management terminal 4 to the data server 10.

Preferably, the unit price schedule data transmitted from the data server 10 to the parlor management terminal 4 are data of two days including the current day and the next day. This is because the game parlor may continue business across the border between the current day and the next day (after 24 o'clock).

The unit schedule is transmitted in this way from the data server 10 to each of the game parlors ST1 to STn and retained in the parlor server 3.

On the other hand, a plurality of the game terminals GT1 to GTn in the parlor accesses the corresponding parlor server 3 in each predetermined time interval shorter than a quarter of an hour (15 minutes) as described above, for example, every two minutes, to perform transmission request polling for the unit price data (step S3).

By accessing at a time interval shorter than the predetermined unit time, the unit price setup can be certainly changed in each predetermined unit time without an error. The settling process can be started with a shorter waiting time without waiting for the predetermined unit time.

That is, the game terminals GT1 to GTn access the parlor server 3 to acquire data of a unit price set for the current time and a unit price that should be set for the next 15-minute time period.

Since the time adjustment is performed basically by the previous terminal initialization (step S1), the unit price setup value at the current time should have no differences between the game terminal GT1 to GTn and the parlor server 3. However, if the unit price at the current time set in the game terminal GT1 to GTn is different from the unit price acquired from the parlor server 3 because, for example, the unit price information is not updated due to a communication failure, the unit price is corrected and changed to the current unit price acquired from the parlor server 3.

If the unit price to be set for the next 15-minute time period is different from the unit price setup value at the current time (Y at step S4), the game terminal GT1 to GTn changes the setting when the next time period starts (step S5).

The above process (step S2 to step S5) is continuously performed during business hours (N at step S6).

As set forth hereinabove, the present invention forms schedule data in a data server and the schedule data are acquired and retained in a corresponding parlor server. A plurality of game terminals inquires the corresponding parlor server for the schedule data at a predetermined timing to change unit price setup of the own terminal at any time.

Therefore, the game terminal can be realized with a simple configuration without the need of a configuration including the scheduling data, can constitute a game system inexpensively, and can change the unit price setup easily. This can enhance the attraction for customers and contributes greatly to the industry.

While the illustrative and presently preferred embodiments of the present invention have been described in detail herein, it is to be understood that the inventive concepts may be otherwise variously embodied and employed and that the appended claims are intended to be construed to include such variations except insofar as limited by the prior art.

What is claimed is:

1. A game system comprising:

a server system including a data server retaining unit price schedule data including game unit prices, respectively set for each of predetermined unit time periods, and generating a master clock; and at least one game parlor system connected via an external network to the server system, including:

a parlor server to periodically access the data server to synchronize a timer with the master clock, and obtain the unit price schedule data retained at the data server of the server system; and a plurality of game terminals connected via a local area network to the parlor server respectively to access the parlor server to synchronize with the timer, when powered-on, and to access the parlor server at a time interval shorter than a predetermined unit time period to acquire a unit price in accordance with the unit price schedule obtained from the data server by the parlor server, wherein when a current unit price is different from the unit price acquired from the parlor server, the plurality of game terminals change and set the game unit price to the unit price scheduled for the next unit time period at the starting time of the next unit time period.

2. The game system according to claim 1, wherein the game parlor further comprises a parlor management terminal to perform an update process of the unit price schedule on an interface screen provided from the server system or created through image generation by the parlor management terminal itself.

3. The game system according to claim 2, wherein the interface screen provided from the server system is a web browser screen of the server system.

4. The game system according to claim 2, wherein the interface screen created through image generation by the parlor management terminal itself is created with a browser plug-in provided from the server system.

5. The game system according to claim 2, wherein the parlor management terminal registers the plurality of game terminals as a unit price group and applies a corresponding unit price schedule to game terminals included in the unit price group on the interface screen.

6. The game system according to claim 2, wherein each of the plurality of game terminals includes a game device and a settlement terminal linked to the game device, wherein the parlor management terminal registers the game device and the settlement terminal linked to the game device on the interface screen, and wherein the settlement terminal linked to the registered game device processes a unit price in accordance with the unit price schedule for a game executed on the game device.

7. The game system according to claim 6, wherein when the parlor management terminal registers the game device and the settlement terminal linked to the game device, if a plurality of the settlement terminals is associated with one game terminal, registration is performed to link the plurality of the settlement terminals to the game device constituting the game terminal.

* * * * *